US006525463B1

(12) United States Patent
Choi et al.

(10) Patent No.: US 6,525,463 B1
(45) Date of Patent: Feb. 25, 2003

(54) FLAT PANEL DISPLAY DEVICE

(75) Inventors: Pan Kyu Choi, Kyungki-do (KR); Je Gwang Yoo, Kyungki-do (KR); Chang Ho Song, Seoul (KR)

(73) Assignee: Samsung Electro-Mechanics Co., Ltd. (KR)

( * ) Notice: Subject to any disclaimer, the term of this patent is extended or adjusted under 35 U.S.C. 154(b) by 0 days.

(21) Appl. No.: 09/323,520

(22) Filed: Jun. 1, 1999

(30) Foreign Application Priority Data

Jun. 11, 1998 (KR) ..... 98-21714

(51) Int. Cl.[7] ..... H01J 1/50; H01J 63/06; H01J 29/46

(52) U.S. Cl. ..... 313/497; 313/497

(58) Field of Search ..... 313/495, 496, 313/497, 309, 336, 351, 421, 422, 423; 335/210, 213; 315/366, 169.3

(56) References Cited

U.S. PATENT DOCUMENTS 5,889,363 A * 3/1999 Beeteson et al. ..... 313/495
6,002,204 A * 12/1999 Beeteson et al. ..... 313/495
6,181,059 B1 * 1/2001 Beeteson ..... 313/422
6,208,091 B1 * 3/2001 Beeteson et al. ..... 315/366
6,246,165 B1 * 6/2001 Beeteson ..... 313/422

FOREIGN PATENT DOCUMENTS

| | | |
|---|---|---|
| GB | 2 304 981 A | 3/1997 |
| GB | 2 304 983 A | 3/1997 |
| GB | 2 304 984 A | 3/1997 |
| GB | 2 304 985 A | 3/1997 |
| GB | 2 304 986 A | 3/1997 |
| GB | 2 304 987 A | 3/1997 |

* cited by examiner

*Primary Examiner*—Michael H. Day
*Assistant Examiner*—Mack Haynes
(74) *Attorney, Agent, or Firm*—Renner, Otto, Boisselle & Sklar, LLP

(57) ABSTRACT

A flat panel display device comprises a cathode on a first substrate for emitting electrons, a magnetic plate including first region focusing electrons emitted from the cathode to display an image and second region for applying the uniform magnetic field into the holes in the first region, and a fluorescent layer on the second substrate, on which the electrons outputted from the holes are impacted. In the second region, there are holes having the same shape and pitch as the first region.

25 Claims, 8 Drawing Sheets

FLAT PANEL DISPLAY DEVICE

BACK GROUND OF THE INVENTION

The present invention relates to a flat panel display device, and more particular to an electron supplying device of the flat panel display device having a magnetic plate supplying the uniform magnetic field to holes thereof to form an electron beam to be impacted to the screen.

The cathode ray tube (CRT) used for the display device such as television and personal computer, etc., has problem that the size is increased in accordance with the display area. In order to overcome this problem the flat panel display including a liquid crystal display device, a field emission display device, a plasma display panel device, and a vacuum fluorescent display device has been introduced recently. Since these flat panel display device requires the high level technology such as the semiconductor device process, however, the manufacturing process is complex and the cost is increased. In case of the fabrication of the large size device, further, there are problem such as the image quality deterioration and the color shift phenomenon.

SUMMARY OF THE INVENTION

It is an object of the present invention to provide a magnetic plate having a first region including a plurality of holes in which the magnetic field is applied and a second region formed in the outer peripheral portion of the first region to apply the uniform magnetic field into the holes all over the first region of the magnetic plate.

It is another object of the present invention to provide an electron supplying device for focusing the electrons to be flowing into the holes to generate an electron beam.

It is another object of the present invention to provide a flat panel display device in which the electron beam generated by the magnet of the magnetic plate is impacted into a screen to display the image.

In order to achieve the object, the magnetic plate according to one aspect of the present invention comprises a first region having a plurality of holes for focusing the electron inputted from the outside of the magnetic plate by the magnetic field to generate the electron beam; and a second region formed in the outer peripheral portion of the first region to supply the uniform magnetic field to the holes all over the first region.

The holes of the circular shape or the rectangular shape in the first region are arranged in a plurality of rows and columns at uniform pitch. In the second region, further, a plurality of holes is also arranged in the same shape and pitch as the first region.

The electron supplying device according to the other aspect of the present invention comprises a cathode for emitting the electrons; a magnetic plate having a first region and a second region, the first region including a plurality of holes for focusing the electrons emitted from the cathode to generate the electron beam by the magnetic field, the holes being arranged in two dimension matrix, the second region being formed in the outer peripheral portion of the first region to apply the uniform magnetic field into the holes all over the first region; a grid electrode for controlling the flow of the electrons flowing into the holes of the magnetic plate, the grid electrode being positioned between the cathode and the magnetic plate, and first and second anodes for accelerating the electrons flowing into the holes, the first and second anodes being arranged parallel along both sides of the columns of the holes in the surface of the magnetic plate that do not face the cathode.

The holes of the circular shape or the rectangular shape are arranged in a plurality of rows and columns at uniform pitch in the first region. In the second region, further, a plurality of holes is arranged in the same shape and pitch as the first region. The grid electrodes are arranged in matrix on the surface of the cathode or the surface of the magnetic plate facing to the cathode, and the holes are formed at the intersection of the grid electrodes. The grid electrodes and the anodes are formed in only the first region, but could be extended to the second region. The first and second anodes are electrically connected to the neighboring the first and second anodes, respectively.

The flat panel display device according to the another aspect of the present invention comprises a cathode for emitting the electrons; a magnetic plate having a first region and a second region, the first region including a plurality of holes for focusing the electrons emitted from the cathode to generate the electron beam by the magnetic field, the holes being arranged in a plurality of rows and columns, the second region being formed in the outer peripheral portion of the first region to apply the uniform magnetic field into the holes all over the first region; a plurality grid electrodes for controlling the flow of the electrons flowing into the holes of the magnetic plate, the grid electrodes being formed between the cathode and the magnetic plate; first and second anodes for accelerating the electrons flowing into the holes, the first and second anodes being parallel arranged along both sides of the column of the holes in the surface of the magnetic plate that do not face the cathode; a screen having a fluorescent layer over the surface facing the surface of the magnetic plate on which the anodes are arranged; and a controlling signal supplying means for supplying the controlling signal to the grid electrodes and the anodes to control selectively the stream of the electrons impacted into the fluorescent layer from the cathode.

The holes of circular shape or the rectangular shape are arranged in a plurality of rows and columns at pitch b in the first region and a plurality of holes having the same shape and pitch as the first region are formed in the second region. The grid electrodes are arranged in matrix in the surface of the cathode or the surface of the magnetic plate opposing to the cathode, and the holes are arranged at the intersection of the grid electrodes. The grid electrodes and the anodes are formed in only the first region, but could be extended to the second region. The first and second anodes are electrically connected to the neighboring the first and second anodes, respectively.

The fluorescent layer includes a plurality of red, green, and blue elements to be repeated thereon. The refractive signal is applied to the first and second anodes to refract the electrons flowing out the holes of the magnetic plate, so that the refracted electrons are impacted to each element of the fluorescent layer to generate the image on the screen.

The cathode, the magnetic plate, and the screen spaced in uniform gap by a spacer are sealed and then evacuated. The spacer is smaller than the width of the second region of the magnetic plate, so that the spacer is positioned in a part area or the whole area of the second region.

DETAILED DESCRIPTION OF THE INVENTION

Hereinafter, the electron supplying device will be described in detail accompanying drawings.

The flat panel display device of this invention includes the advantage of the conventional CRT. In addition, the flat panel display device of this invention has the simplified structure and the low production cost. In this invention, that is, a screen of the conventional CRT is used, further a plane cathode device is used to emit uniformly the electrons and the permanent magnetic plate having holes formed therein in a matrix is used to focus the electrons. This display device had been disclosed in U.K. patent Nos. 204,981-204,988.

Figure 1:
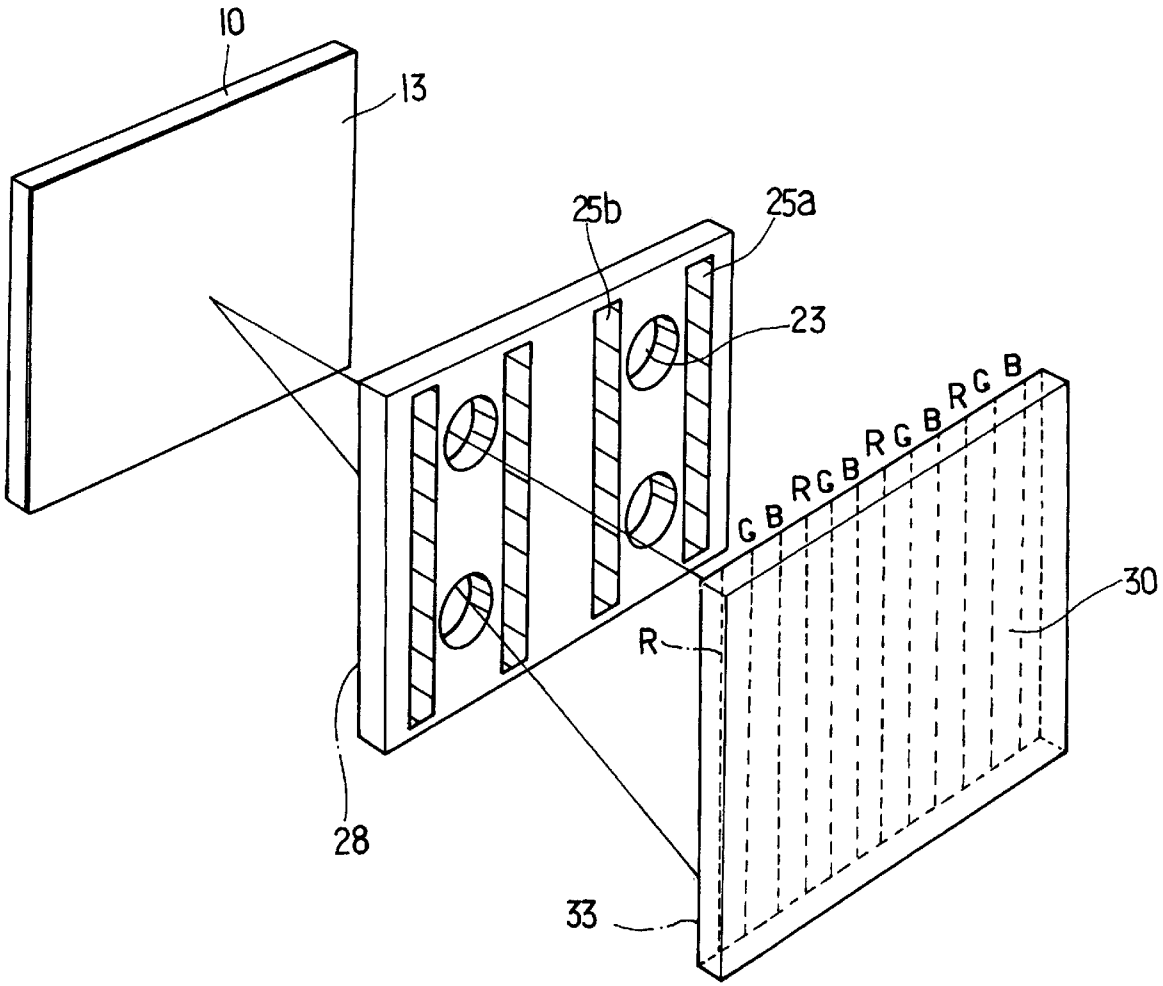
FIG. 1 is a view showing an electron supplying device of the present invention.

FIG. 1 is a view showing the flat panel display device according to the present invention. As shown in figure, the flat panel display device of the present invention comprises a first substrate having a cathode 13 for emitting the electrons, a second substrate 30 including a glass plate on which a fluorescent layer having the repeated red(R), blue (B), and green(G) fluorescent elements is formed, the magnetic plate 20 between the first substrate 10 and second substrate 30 to focus the electrons emitted from the cathode 13. The second substrate 30 having the fluorescent layer 33 is a screen that the image is displayed. Not shown in figure, a third anode layer is formed over the fluorescent layer 33. The magnetic plate 20 is the permanent magnetic plate having a plurality of holes 23 arranged in the matrix. Controlling grid electrodes 28 are formed in the first surface of the magnetic plate 20, facing to the cathode 13. In the second surface of the magnetic plate 20 facing to the fluorescent layer 33, first anodes 25*a* and second anodes 25*b* are arranged along both side of holes 23 in the row direction. The grid electrodes 28 include the first and second grid electrodes arranged in a plurality of rows and columns, and the holes 23 are arranged at the intersection of the first and second grids.

In above flat panel display device, the electrons emitted from the cathode 13 are attracted to the controlling grid electrode 28 by applying the voltage thereto and then flowing into the holes 23. By the magnetic plate 20, the magnetic field having certain intensity is applied into the holes 23. The electrons flowing into the holes 23 are accelerated by the first and second anodes 25*a*,25*b* on the second surface of the magnetic plate 20 and refracted by the voltage difference between the first and second anodes 25*a*,25*b*. In other word, the electrons travels straight to the fluorescent layer 33 through the holes 23 in case where there is no voltage difference between the first and second anodes 25*a*,25*b*, so that the traveled electrons are impacted into the green element of the pixel having the ordered R,G,B elements. In case where the voltage of the first anodes 25*a* is different from that of the second anodes 25*b*, the electrons are refracted by the voltage difference between the first and second anodes 25*a*,25*b*. As a result, the electrons are impacted into the red element or the blue element of the pixel. Since approximate voltage of 10 keV is applied to the third anode 33 over the fluorescent layer 33, the electron beam from the holes 23 is accelerated toward the fluorescent layer 33.

Figure 2A:
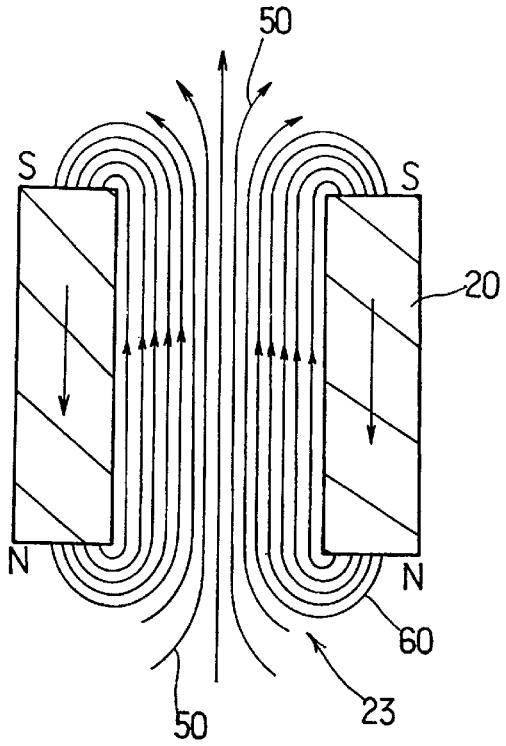
FIG. 2A is a view showing a magnetic field passing through the holes of the electron supplying device according to the present invention.
Figure 2B:
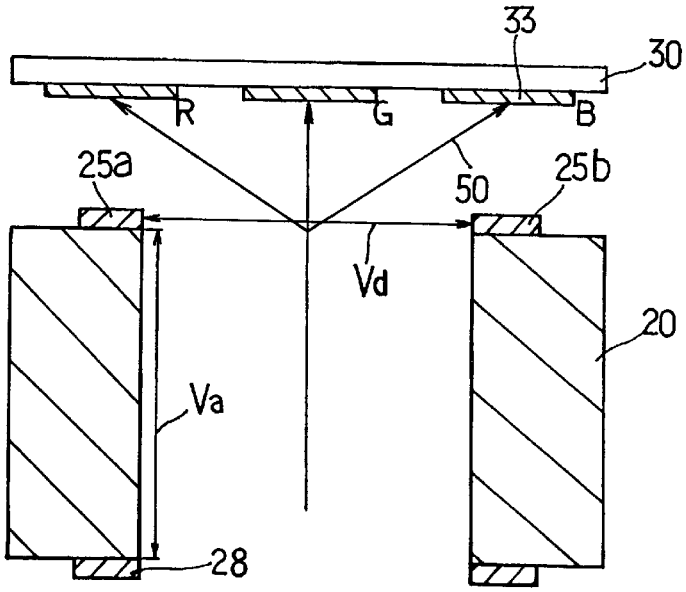
FIG. 2B is a view showing the trajectory of the electrons passing through the holes of the electron supplying device according to the present invention.

FIG. 2A is a view showing the magnetic field passing through the holes 23 and the trajectory of the electrons caused by the magnetic field, and FIG. 2B is a schematic view showing the electric field passing through the holes 23 and the trajectory of the electrons caused by the electric field. At this time, only the magnetic field by the magnet around the single hole is represented for the simplified description. As shown in FIG. 2B, the electrostatic potential Va is applied between the first and second surface of the magnetic plate 20 by the voltage difference between the grid electrodes 28 and the first and second anodes 25*a*,25*b*, and the electrostatic potential Vd is applied between the first and second anodes 25*a*,25*b* arranged in both side of the upper portion of the hole 23.

The electrons emitted from the cathode 13 have the relative low velocity near the first surface of the magnetic plate 20. That is, the electrons in this region form the electron cloud-state having the random travelling direction. As the electrons are attracted by the electrostatic potential Va, the velocity of the electrons in the vertical direction is increased. If the electrons are moving in the same direction of the magnetic field, since there is no lateral force on the electrons, the electrons are traveled along the electric field. Since the electrons generally travel in the different direction from the direction of the magnetic field, however, the electrons are acted by the force in the different direction from that of the electric field.

The electrons moving in the magnetic field are acted by the magnetic field perpendicular to the direction of the velocity of the electrons and the direction of the electric field (Fleming's right handed law). Therefore, the electrons are moving in circular motion in the uniform magnetic field. However, these electrons are helically moving because of the acceleration of the electrons caused by the electric field. The radius of the helix is dependent upon the intensity of the magnetic field and the velocity of the electrons, so that the period of the helix may be controlled with the velocity of the electrons. When the surface of the magnetic plate 20 is referred to 'x-y plane', the radius r of the helix is mv/qB in the x-y plane (where, m is mass of the electron, v is velocity of the electron, and q is amount of the electric charge). Comparing with the intensity of the magnetic field in the center of the holes 23, the intensity of the magnetic field near the second surface of the magnetic plate 20 is decreased in half and the radius thereof is becomes double. Further, the radius of the helix is continuously increased in accordance with the travelling of the electrons into the fluorescent layer 33 from the holes 23. Although the electron beam is diverged by the rapid decrease of the magnetic field, the diverging effect may be decreased by the acceleration of the electrons by the third anode.

Figure 3:
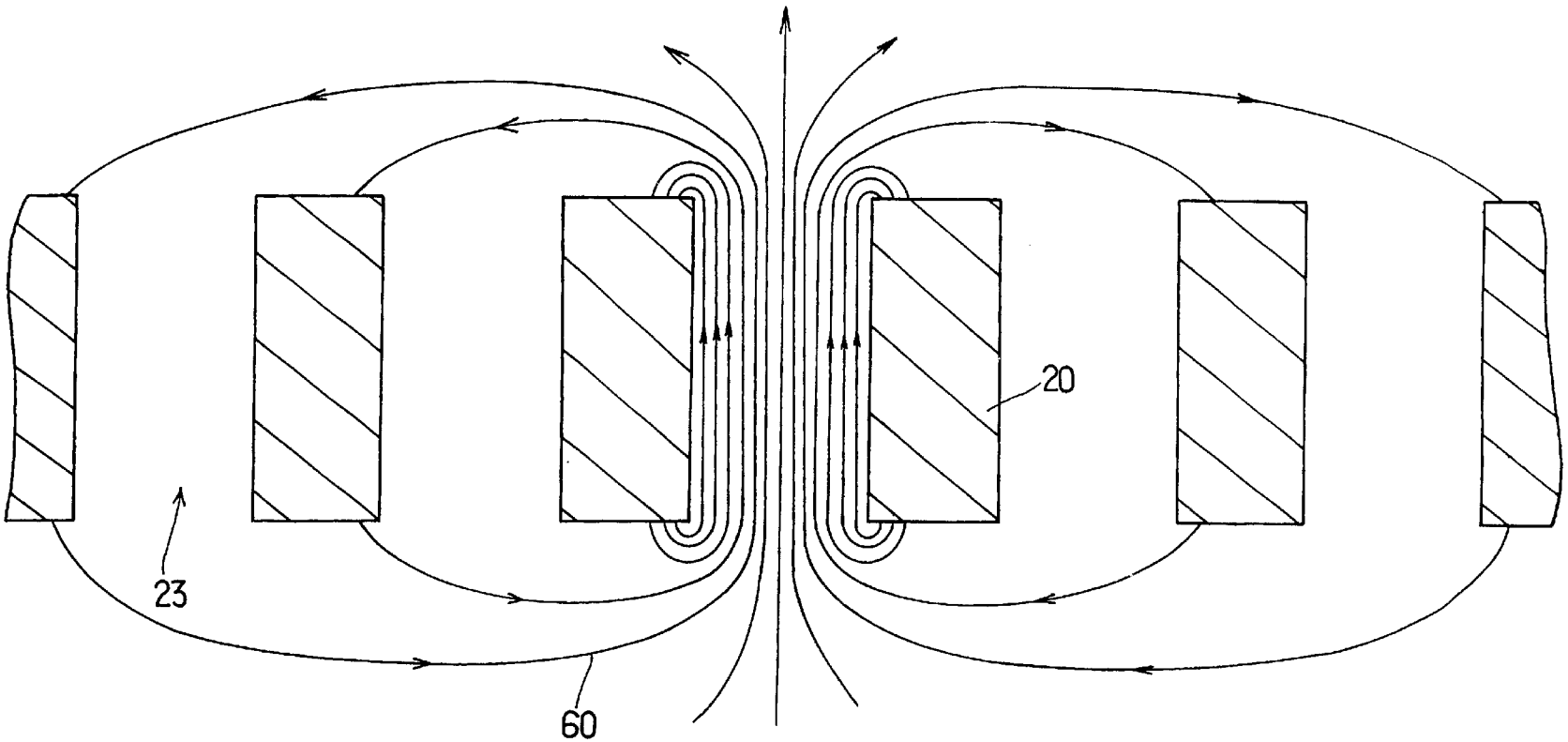
FIG. 3 is a view indicating the practical magnetic field caused by the magnetic plate applied to the present invention.

FIG. 2A indicates the magnetic field 60 passing through the holes 23 by only the magnet of the magnetic plate 20 around the holes 23, but the practical magnetic field 60 is also caused by the other portion of the magnet of the magnetic plate 20. Referring to FIG. 3, the magnetic field 60 passing through the holes 23 is also generated by the magnet of the magnetic plate 20 apart from the holes 23 at least one pitch. At that time, the magnetic field caused by the magnetic plate around the holes 23 is most significant, but the magnetic field by other portion is also important.

Figure 4:
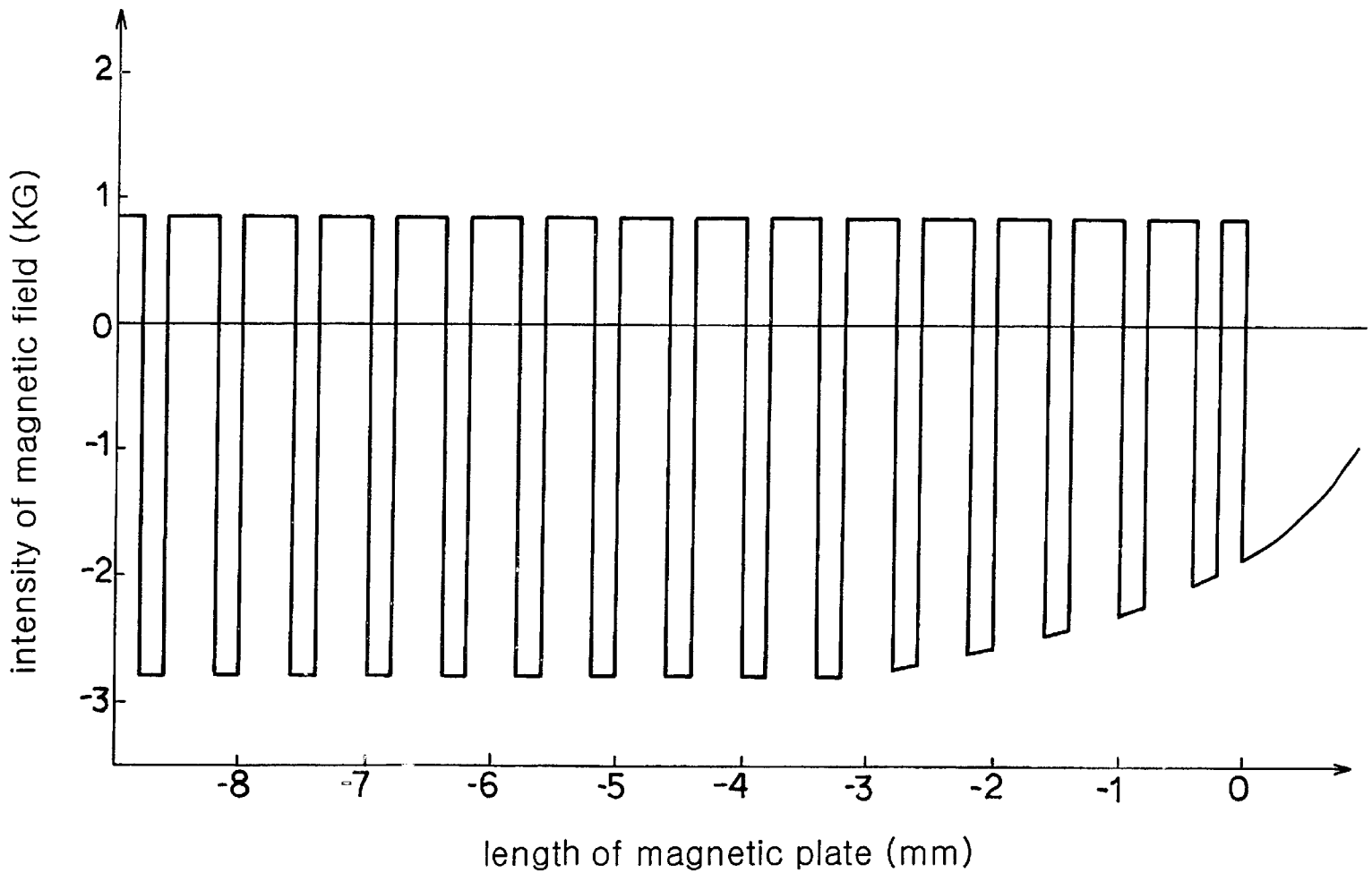
FIG. 4 is a graph of the intensity of the magnetic field caused by the magnetic plate shown in FIG. 3.

FIG. 4 is a graph showing the intensity of the magnetic field in the magnetic plate including thirty holes having 0.2 mm of the hole diameter and 0.6 mm of the hole pitch. In the figure, x-axis is the length of the magnetic plate 20 and the y-axis is the intensity of the magnetic field. The periphery of the magnetic plate 20 corresponds to x=0. As shown in FIG. 4, the uniform magnetic field of 900 G is applied at the inside of the magnetic plate 20. At the inside of the holes 23, the intensity of the magnetic field in the central portion of the magnetic plate 20 is different from intensity in the peripheral portion. In other word, the magnetic field passing through the fifth hole 23 from the periphery of the magnetic plate 20 is approximately 2600 G, while the field in the central portion thereof is approximately 2800 G. This field is gradually decreased as approaches the peripheral portion. The field passing through the holes 23 of the central portion is caused by the magnet around the holes 23 and the magnet within the certain area from the holes 23. However, the magnet area generating the field passing through the holes 23 is decreased in the peripheral portion of the magnetic plate 20, thus the intensity of the magnetic field is also decreased. As shown FIG. 4, the magnet area affecting the field at the inside of the holes 23 is approximately five times of the pitch of the holes 23.

The difference of the magnetic intensities in the central and peripheral portion causes the deterioration of the image quality when the magnetic plate 20 is used in the flat panel display device. The electrons emitted from the cathode 13 are gathered near entrance of the holes 23 as the voltage is applied to the grid electrodes 28, but the electrons are flowing into the holes 23 by the magnetic field passing through the holes 23. Thus, the variation of the magnetic field causes the amount of the electrons flowing into the holes 23, which means the variation of electron density impacting to the fluorescent layer 33. In the display device, the brightness is dependent upon the density of the electron impacting the fluorescent layer 33. Therefore, the difference of the magnetic field in the central and peripheral portions of the magnetic plate 20 causes the variation of the brightness on the screen.

Figure 5A:
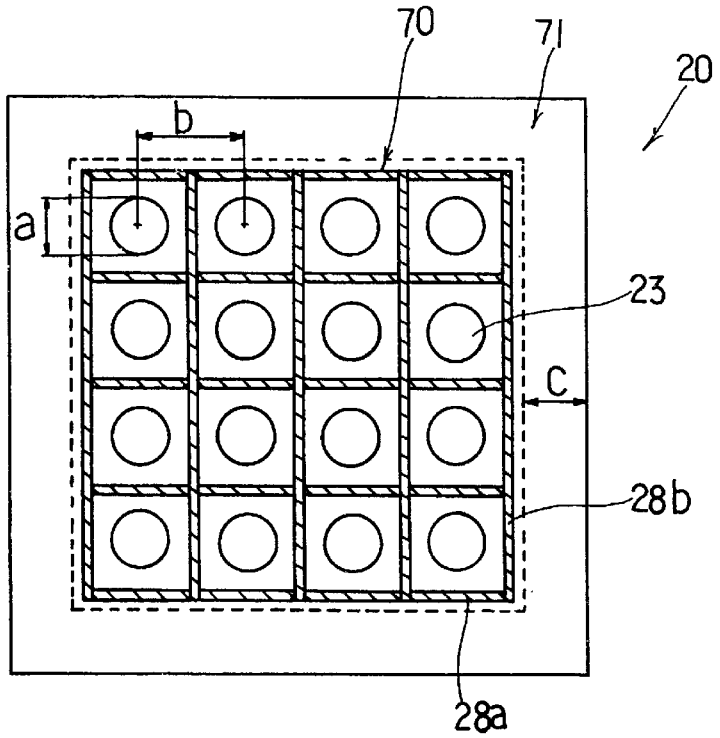
FIG. 5 is a view indicating a first embodiment of the present invention.

FIG. 5 is a view showing the magnetic plate according to the first embodiment of the present invention. As shown in figure, the magnetic plate 20 comprises a first region 70 including a plurality of holes 23 and a second region 71 in the outer peripheral portion the first region 70. The holes 23 are arranged in the matrix of n×m in the first region. The holes 23 are not formed in the second region 71. The holes 23 may be formed in the rectangular shape, preferred in the circular shape. Further, it is possible to form the holes 23 in any shape to focus the electron. The image is displayed in the first region 70. The number of the holes 23 is identical with that of the pixel. Corresponding to the number of the holes 23 in the first region 70 of the magnetic plate 20, that is, there are pixels of n×m on the screen. The diameter of the holes 23 is 'a' and pitch is 'b'. The second region 71 formed in the predetermined width applies the magnetic field to the holes 23 in the peripheral portion of the first region 70 to supply the uniform magnetic field to the holes 23 all over the first region 70.

Figure 5B:
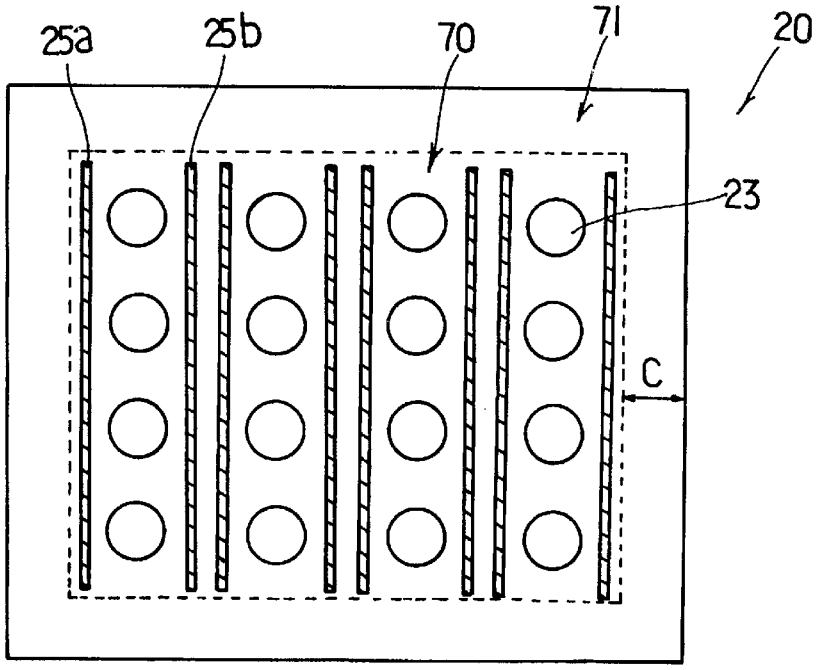
Figure 6:
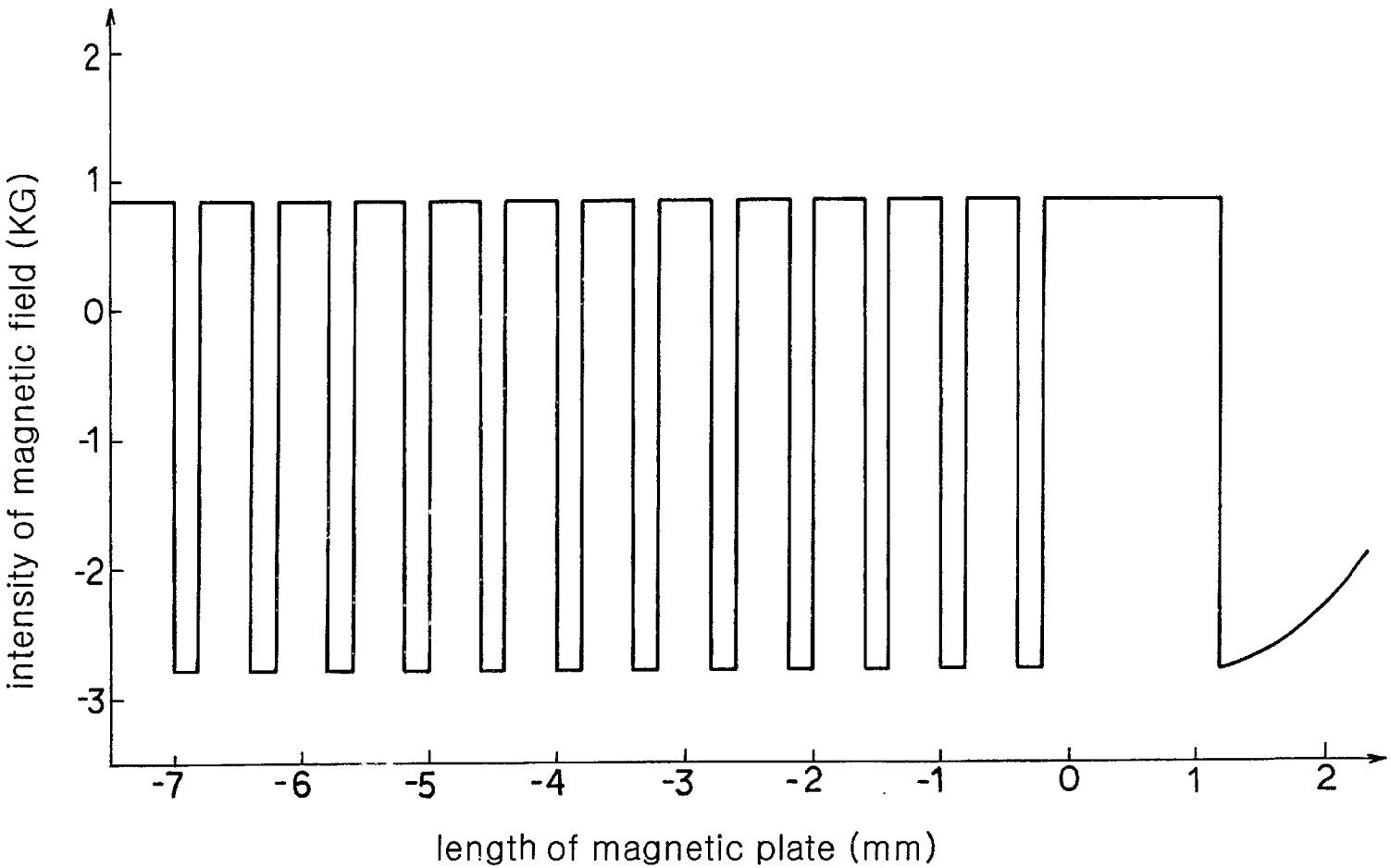
FIG. 6 is a graph of the intensity of the magnetic field caused by the magnetic plate shown in FIG. 5.

FIG. 6 is a graph indicating the magnetic field of the magnetic plate shown in FIG. 5. At that time, the diameter a of the holes 23 is 0.2 mm, the pitch b is 0.6 mm, and the width c of the second region is 2*b*, i.e., 1.2 mm. In this figure, zero of the x-axis is the boundary line between the firs and second regions 70,71, the left part thereof indicate the first region 70 and right part the second region 71. Comparing the graphs of FIGS. 6 and 4, the uniform magnetic field is applied to the total holes 23 in the first region 70, corresponding to the representation area of the screen, by the magnets of the first and second regions 70,71 in FIG. 6, while the magnetic fields of different intensities are respectively applied to the holes 23 in the central and peripheral portions (fifth holes from the boundary of the representation area) of the first region 70 in FIG. 4. Thus, the uniform amount of electrons is flowing into the holes 23, so that the brightness of the image on the screen becomes uniform.

Referring back to FIG. 5A, the grid electrodes 28 arranged in matrix are formed in the first region 70 on the first surface of the magnetic plate 20 facing the cathode 13. The grid electrodes 28 include a plurality of first and second grid electrodes 28*a*,28*b* which correspond to the n+1 rows and m+1 columns of the matrix. The first and second grid electrodes 28*a*,28*b* can be formed on the cathode 13. In other word, the first and second grid electrodes 28*a*,28*b* can be formed at any position between the cathode 13 and the magnetic plate 20. Further, the first and second grid electrodes 28*a*,28*b* can be extended to the second region 71. Each hole 23 is position at the intersection of the first and second grid electrodes 28*a*,28*b*.

On the second surface of the magnetic plate 20, as shown in FIG. 5B, a plurality of first and second anodes 25*a*,25*b* are arranged along the both side of the columns of the holes 23. Generally, the voltage applied to the cathode 13 is 0V and the voltage applied to the first and second anodes is 100V. By the difference of the voltage applied to the cathodes 13 and the anodes 25*a*,25*b*, the electrons flowing into the holes 23 are accelerated. Further, the electrons are refracted by the difference of the voltage applied to the first anodes 25*a* and the second anodes 25*b* to achieve R, G, and B of the pixel of the fluorescent layer 33.

There are four possible state for anodes 25*a*,25*b* causing the electron refraction. This possible state will be described in detail accompanying FIG. 2B as follow.

When the first and second anodes 25*a*,25*b* are turned off, there is no acceleration voltage Va between the cathode 13 and the anodes 25*a*,25*b*, so that the electrons is not flowing into the holes. As a result, the magnetic plate 20 cannot be used in the display device.

When the first and second anodes 25*a*,25*b* are turned on, the symmetric acceleration voltage Va is applied to the electron beam. By the acceleration voltage Va, the electron beam is accelerated and travelling straight. Therefore, the electron beam from the holes 23 is impacted at the G element of the pixel.

If the first anode 25*a* is turned on and the second anode 25*b* is turned off, there is asymmetric acceleration voltage Va. Thus, the electrons are accelerated at the inside of the holes 23 and attracted to the first anode 25*a*, then impacted to the R element of the pixel.

When the first anode 25*a* is turned off and the second anode 25*b* is turned on, the electrons are accelerated and attracted to the second anode 25*b*. As a result, the electron beam is impacted to the B element of the pixel.

The first substrate 10, the magnetic plate 20 and the second substrate 30 are spaced in uniform distance each other by a transparent or opaque spacer(not shown in figure). In this invention, the spacer is positioned in the second region 71 of the magnetic plate 20.

If the spacer is positioned in the first region 70 of the magnetic plate 20, the representation area, the image quality is deteriorated because the spacer in the first region 70 blocks the electron beam impacted to the pixel corresponding to the spacer. To overcome this problem, the spacer is positioned only in the second region 71 of the magnetic plate 20 in this invention.

Further, the anodes 25*a*,25*b* may be extended to the second region 71.

Figure 7:
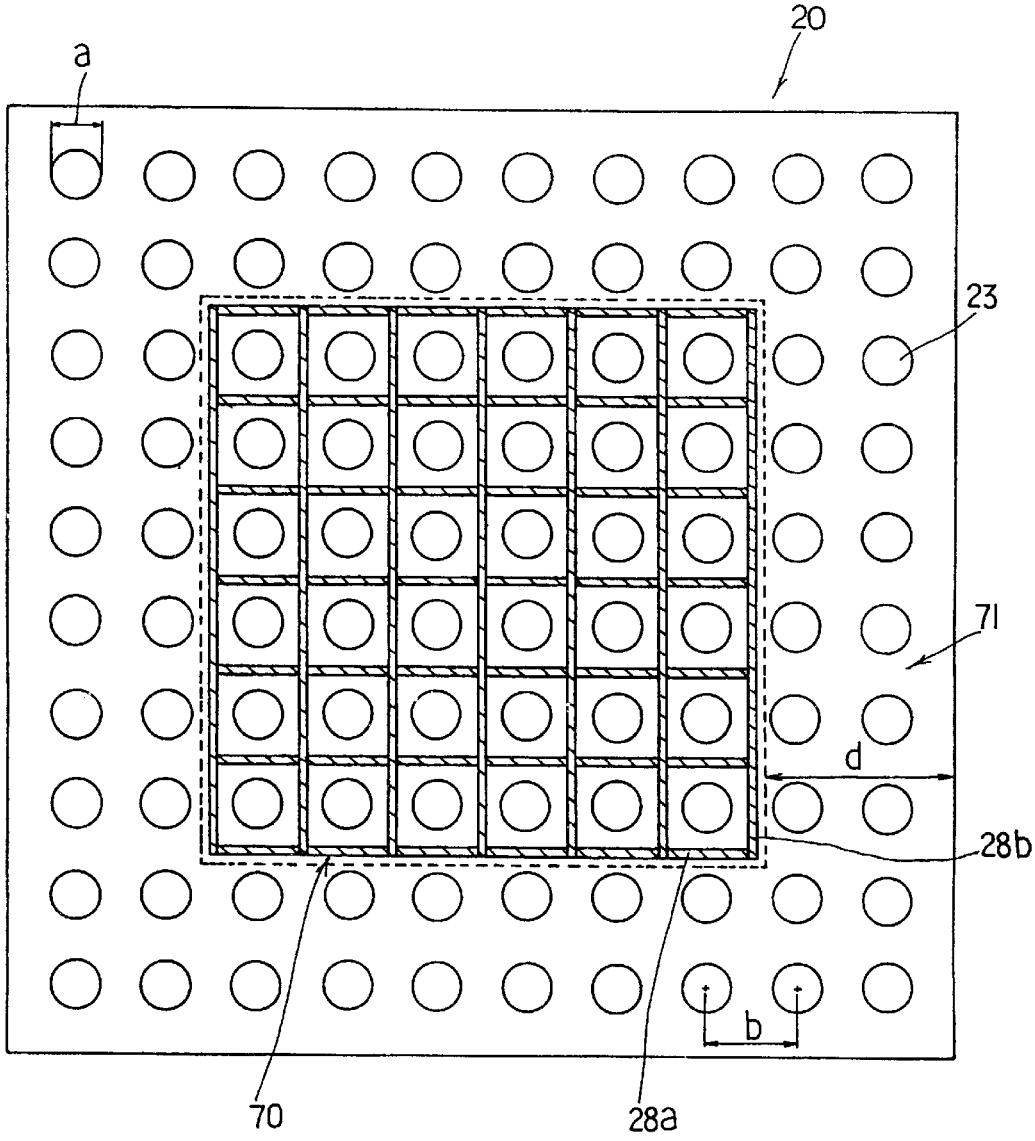
FIG. 7 is a view showing a second embodiment of the present invention.

FIG. 7 is view showing the magnetic plate of the flat panel display according to the second embodiment of the present invention. As shown in FIG. 7, the difference from the first embodiment is merely the holes 23 in the second region 71 of the magnetic plate 20. Thus, only the first surface of the magnetic plate 20 will be described to explain the second embodiment of the present invention. In FIG. 7, the magnet of the second region 71 having width d applies the magnetic field passing through the fifth holes 23 from the boundary between the first and second regions 70,71. Thus, the uniform magnetic field is applied to the holes 23 all over the first region 70. The width d of the second region 71 of the second embodiment is larger than width c of the second region of the first embodiment (i.e., d>c). This is caused by the holes 23 in the second region 71 of the magnetic plate 20. Since the second region 71 of the second embodiment does not include the magnet corresponding to the holes 23, the area of the second region 71 of the second embodiment should be larger than that of the first embodiment to apply the uniform magnetic field into the holes 23 all over the first region 70.

By larger area of the second region 71, the magnetic plate 20 is securely mounted on the flat panel display device. Since the spacer has the certain width, a part of the spacer is overlapped in the first region 70, the representation area, if the width of the first region 70 is too narrow. Thus, the portion in which the image does not displayed is generated. If the narrower spacer is used in the flat panel display device to overcome this problem, it is impossible to mount securely the magnetic plate 20, the first substrate 10, and the second substrate 30. In the second embodiment, thus, the magnetic plate 20, the first substrate 10, and the second substrate 30 can be mounted securely as a flat panel display device by forming the holes 23 in the second region 71, as described above.

As shown in FIG. 7, the holes 23 in the second region 71 are arranged in the same shape and pitch as the first region 70. However, these holes 23 may be arranged in the different shape and the irregular pitch. That is, the holes 23 in the second region 71 of the second embodiment does not limited to the particular shape and pitch.

Figure 8:
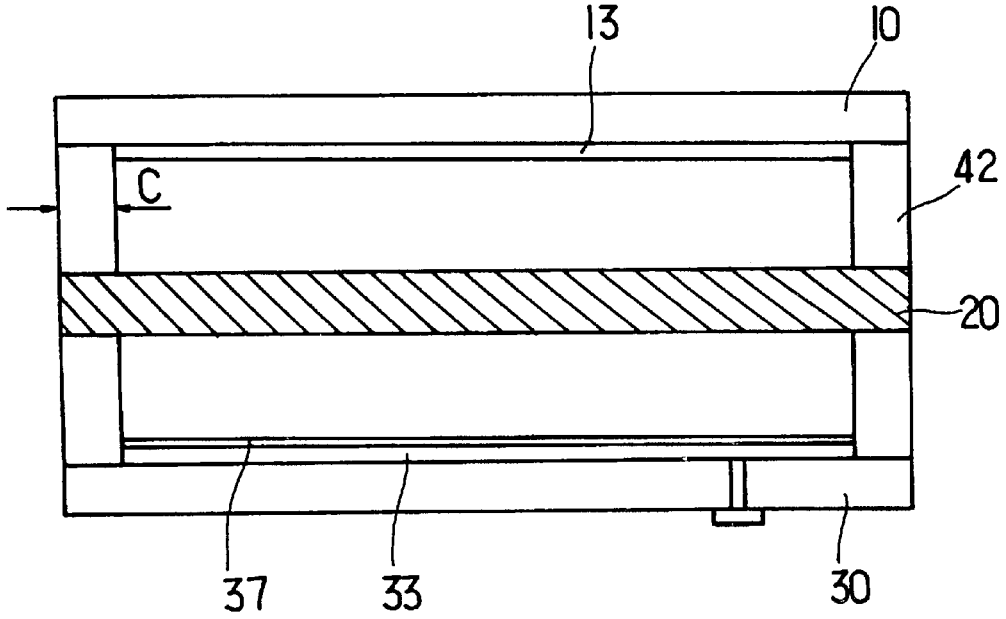
FIG. 8 is a sectional view of the display device according to the present invention.

FIG. 8 is a sectional view showing the flat panel display device in which the magnetic plate is used. As shown in figure, the first substrate 10, the magnetic plate 20, and the second substrate 30 arranged in uniform distance are sealed and then evacuated. The cathode 13 is mounted over the first substrate 10, and the fluorescent layer 33 having R, G, and B elements to be repeated and the third anode 37 are positioned over the second substrate 30. The width of the second region 71 of the magnetic plate 20 is c. In FIG. 8, the width of the spacer 42 is also c. At this time, the width of the spacer 42 can be determined narrower than that of the second region 71.

As described above, since the magnetic plate of the present invention comprises the first region representing the image and the second region having predetermined width, the uniform magnetic field can be applied into the holes all over the first region. Further, the distance between the first and second substrates is maintained uniformly by the spacer in the second region having predetermined width, so that the secure flat panel display device may be fabricated. Since the larger area of the second region can be formed by the holes therein, in addition, the flat panel display device is fabricated more securely.

While the invention has been described in its preferred embodiments, this should not be construed as limitation on the scope of the present invention. Accordingly, the scope of the present invention should be determined not by the embodiments illustrated, but by the appended claims and their legal equivalents.

What is claimed is:

1. A flat panel display device comprising:

a cathode for emitting electrons:

a magnetic plate having a first region and a second region, the first region having a plurality of holes for focusing electrons to be inputted from the cathode to form an electron beam by the magnetic field therein, the second region being formed from a peripheral portion of the magnetic plate, the second region including means for applying the magnetic field to the holes at the peripheral portion of the first region so as to supply a uniform magnetic field to the holes all over the first region;

a plurality of grid electrodes for controlling the electrons flowing into the inside of the holes, the grid electrodes being formed between the cathode and the magnetic plate;

a screen having a fluorescent layer over a surface thereof facing the magnetic plate, the screen being impacted with the electron beam outputted from the magnetic plate to display an image, the screen having a plurality of pixels;

a plurality anodes for accelerating the electrons flowing into the holes, the anode being disposed between the magnetic plate and the screen; and a control signal supplying means for supplying a control signal to the grid electrodes and the anodes to control selectively the stream of electrons impacted on the screen through the holes, wherein the number of the holes of the first region is same as the number of the pixels of the screen.

2. The device according to claim 1, wherein the holes are formed in the circular shape.

3. The device according to claim 1, wherein the holes are formed in the rectangular shape.

4. The device according to claim 1, wherein the grid electrodes are formed in the first region on the surface of the magnetic plate facing the cathode.

5. The device according to claim 4, wherein the grid electrodes are extended to the second region.

6. The device according to claim 1, wherein the grid electrodes are formed on the surface of the cathode facing the magnetic plate.

7. The device according to claim 1, wherein the holes are arranged in a plurality of rows and columns.

8. The device according to claim 7, wherein the holes are arranged in uniform pitch.

9. The device according to claim 7, wherein the grid electrodes are formed in matrix and the holes are positioned at the intersection thereof.

10. The device according to claim 1, further comprising a plurality of holes formed in the second region.

11. The device according to claim 10, wherein the shape and the pitch of the holes in the second region are substantially identical to those of the holes in the first region.

12. The device according to claim 1, wherein the anodes are formed in the first region on the surface of the magnetic plate not facing the cathode.

13. The device according to claim 12, wherein the anodes include a plurality of first anodes and second anodes arranged parallel to each other along both sides of the columns of the holes.

14. The device according to claim 13, wherein the first and second anodes are respectively connected to the neighboring first and second anodes.

15. The device according to claim 12, wherein the anodes are extended to the second region of the magnetic plate.

16. The device according to claim 15, wherein the anodes include a plurality of first anodes and second anodes arranged parallel to each other along both sides of the columns of the holes.

17. The device according to claim 16, wherein the first and second anodes are respectively connected to the neighboring first and second anodes.

18. The device according to claim 1, wherein the fluorescent layer includes a plurality of red, green, and blue elements to be repeated.

19. The device according to claim 1, further comprising refracting means for supplying a refracting signal to the anodes to impact the electrons from the holes into the elements of the fluorescent layer so as to generate the image of the screen.

20. The device according to claim 1, further comprising a third anode for accelerating the electrons outputted from the magnetic plate, the third anode being formed over the fluorescent layer.

21. The device according claim 1, further comprising at least one spacer between the cathode and the magnet plate, and the magnetic plate and the screen forming the substantial vacuum-state space between thereof.

22. The device according to claim 21, wherein the spacer is positioned over at least a part of the second region.

23. The device according to claim 1, wherein the second region does not include holes.

24. The device according to claim 1, wherein the plurality of holes are spaced apart according to a prescribed pitch, and wherein the second region has a width that is twice the pitch of the holes.

25. The device according to claim 1, wherein the holes are circular and the second region has a width that is six times the diameter of a hole.

* * * * *